United States Patent [19]

Bencene et al.

[11] 4,293,970

[45] Oct. 13, 1981

[54] BELT CLEANING APPARATUS

[76] Inventors: Robert C. Bencene, Rte. 4, Jonesboro, Tenn. 37650; Charles A. Granger, #3 Matson Ct., Johnson City, Tenn. 37601

[21] Appl. No.: 52,852

[22] Filed: Jun. 28, 1979

[51] Int. Cl.[3] ..... A46B 13/02

[52] U.S. Cl. ..... 15/21 D; 15/40; 15/77; 51/262 A; 100/156; 226/181

[58] Field of Search ..... 15/21 D, 40, 77, 100, 15/102, 99; 51/262 A, 170 EB; 226/181, 187; 100/156, 176

[56] References Cited

U.S. PATENT DOCUMENTS 2,140,439 12/1938 Williams ..... 15/99

2,297,107 9/1942 Magnuson ..... 15/99

*Primary Examiner*—Edward L. Roberts

[57] ABSTRACT

Disclosed is a cleaning apparatus for continuous, abrasive belts of essentially any dimension, which apparatus has a base having elongated belt supporting mandrel means mounted thereon, and belt drive roll means rotatably mounted on the base and having its rotational axis substantially parallel to the axis of the mandrel means, and wherein a first portion of the periphery of the mandrel means is movable substantially parallelly into close juxtaposition to the periphery of the drive roll means upon angular movement of the mandrel means relative to the drive roll means in order to provide for easy loading and unloading of the belts while providing positive belt driving force.

10 Claims, 5 Drawing Figures

BELT CLEANING APPARATUS

This invention concerns novel belt cleaning apparatus, particularly for continuous abrasive belts, and more specifically concerns unique belt advancing means for positioning portions of continuous belts of any length at various cleaning stations, and also concerns means allowing quick release from the belt advancing means for allowing rapid removal and loading of the belts onto the apparatus.

In many industries such as the furniture industry large numbers of expensive belts of all types including abrasive, polishing, and the like, are employed in operations such as sanding wood or other substrates which deposit particulate matter, resins, and other clogging materials on the belts. A major concern in these industries is to clean the belts without employing expedients which tend to harm the belt and reduce its life. Such expedients may include the use of solvents in dip operations which can destroy the belt backings if incorrectly managed, and the use of abrading devices such as stiff brushes or the like which can physically damage the belt if not used in a carefully controlled manner. At the same time, the cleaning operation must proceed rapidly and efficiently in order to be economically feasible. Such cleaning equipment is unknown to the art, particularly where it must accommodate the large dimensional variations of commercial continuous belts. Such belts may vary in sizes, for example, from one foot or less to several feet in length and from widths in inches to widths of several feet. The economics of cleaning such belts does not justify the use of apparatus which requires dimensional adjustments or physical modification of its parts including supporting mandrels, rollers, belt tensioning components, or the like. Such alterations are much too time consuming and labor oriented to be economically justifiable.

Objects, therefore, of the present invention are to provide a continuous belt cleaning apparatus which can accommodate belts of substantially any dimension without any physical or dimensional adjustment or alteration of its parts; and to provide such apparatus with means to allow easy and rapid unloading and loading of belts thereon.

These and other objects hereinafter appearing have been attained in accordance with the present invention through novel apparatus structure comprising a base having elongated belt supporting mandrel means angularly, movably mounted thereon, and belt drive roll means rotatably mounted on the base and having its axis substantially parallel to the axis of the mandral means, and wherein a portion of the periphery of the mandrel means being substantially parallelly movable into close juxtaposition to the periphery of the drive roll means upon angular movement of the mandrel means relative to the drive roll means.

In a more specific embodiment of the invention the apparatus comprises a base having drive roll means rotatably mounted thereon and adapted to extend outwardly therefrom in a substantially horizontal plane and mandrel means rotatably mounted on said base and having a plurality of substantially parallel rollers extending substantially parallel to said drive roll means, at least one of said rollers of said mandrel means being movable into close juxtaposition to the periphery of said drive roll means upon rotation of said mandrel means.

The invention is further described in the following description and drawings wherein.

Figure 3:
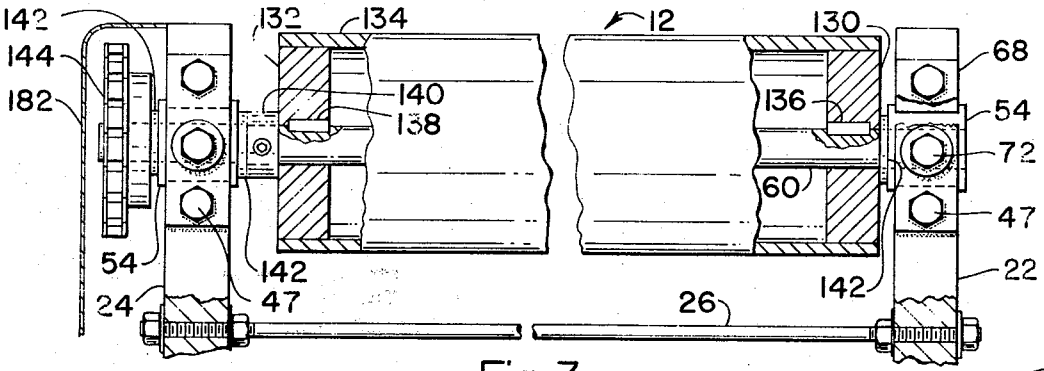
FIG. 3 is a partially schematic side view of the apparatus of FIG. 1 taken along line 3—3 thereof in the direction of the arrows.

Referring to the drawings, the belt cleaning apparatus comprises a base generally designated 10, a plurality of work stations which in the embodiment shown comprises the work rolls, i.e., drive roll 12, brush roll 14, solvent applicator roll 16, and drag or friction roll 18, and a belt mandrel generally designated 20. The base is shown constructed of end plates 22 and 24 maintained in spaced relationship by means of bolts 26 as shown in FIGS. 1 and 3.

The end plates, in the embodiment shown, are adapted to receive adjustable bearings, generally designated 28 and 30 for rotatably supporting the aforesaid rolls, and which are adjustable within slots 32 cut in the end plates and extending outwardly through the edge surfaces 33 thereof. The adjustable bearings 28 which are shown in use for the brush roll 14 and solvent roll 16 comprise a housing 34 slidable within fairly close tolerances within slot 32 and are provided adjacent their edges with flanges 36 which lie adjacent the sides of the end plates and lock the housings 34 within the slots 32 while allowing sliding motion therein. Sleeve or other type bushings or bearings 38 are secured in the housings, e.g., by press fitting, and rotatably receive the ends of the roller shafts 40 and 42. The housings 34 are rendered adjustable within slots 32 by means of screws 44 which are threaded through caps 46 secured by bolts 47 to edge surfaces 33 of the end plates, and which slidably pass through apertures 48 in the ends of housings 34, and which are provided with collars 50 pinned thereto and freely rotatable within transverse slots 52 in the housings.

The adjustable bearings 30 which are shown in use for drive roll 12 and drag roll 18 comprise housings 54 which may be identical to housings 34 with respect to flanges 36 which slidably hold the housings within slots 32 in the end plates, and with respect to bearings 56 and 58 which rotatably receive shafts 60 and 62 respectively of drive roll 12 and drag roll 18. Housings 54 are adjustable in the sense that they are continually urged inwardly toward the mandrel by springs 64 conveniently contained in tubes 66 secured as by welding to caps 68 and seating on the ends 70 of the housings. The spring force on the housings may be adjusted by means of bolts 72 threaded through the ends 74 of tubes 66. A round, flat plate 76 provides a bearing surface between bolt 72 and spring 64.

Figure 1:
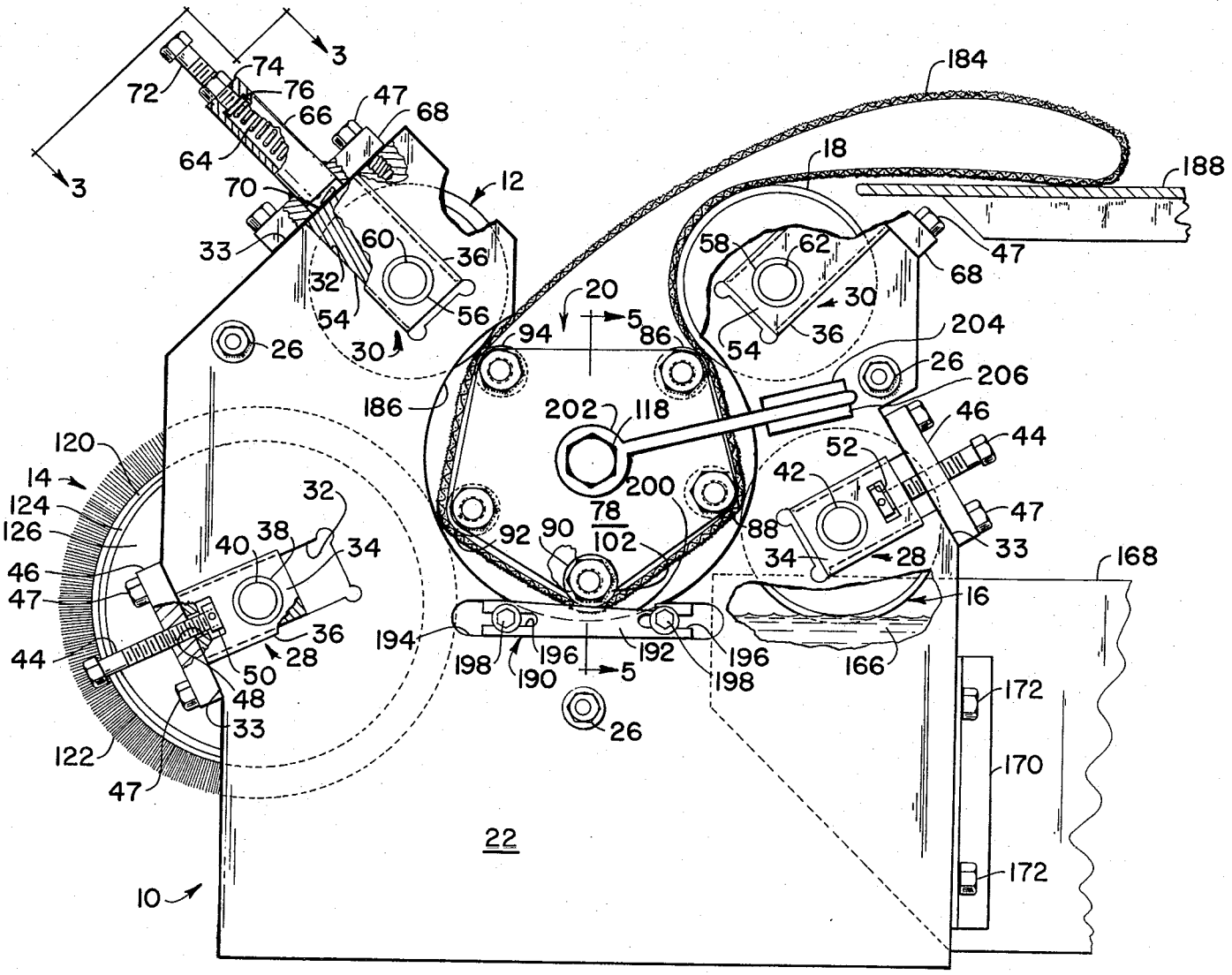
FIG. 1 is an end view of the apparatus, partially in section.
Figure 5:
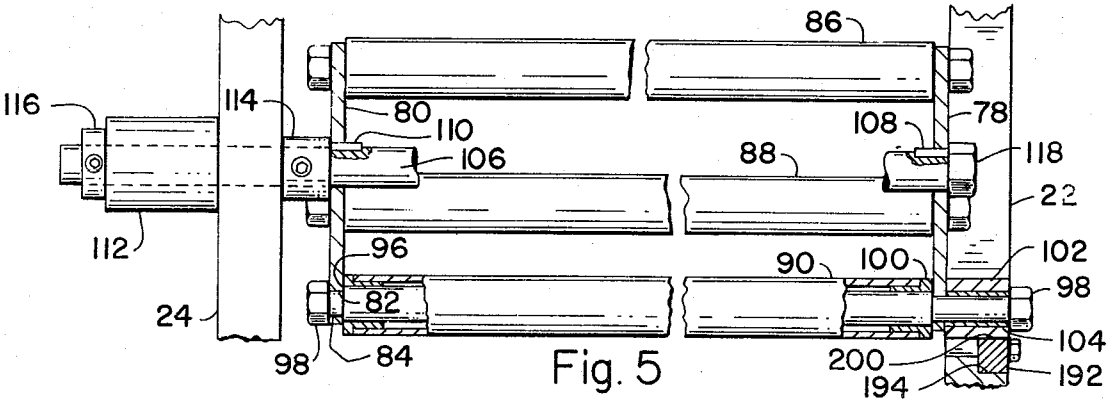
FIG. 5 is a side view of the mandrel partly in section taken along line 5—5 of FIG. 1 in the direction of the arrows.

Referring to FIGS. 1 and 5, the mandrel 20 in the embodiment shown comprises roller end supports 78 and 80 of a generally pentagonal configuration, having shaft apertures 82 located through its apex portions receiving the reduced end segments 84 of the supporting shafts of rollers 86, 88, 90, 92 and 94. Supports 78 and 80 are rigidly locked to the roller shafts by means of shoulders 96 on the shafts and nuts 98 which compress against the supports. The rollers are rotatable on their supporting shafts by means of flanged bushings 100 which are pressed into the rollers and rotate therewith. A follower roller 102 is shown on the reduced end of the shaft of roller 90 and is rotatable on fixed bushing 104 for a purpose described hereinafter.

The mandrel 20 is supported on a shaft 106 which is keyed at 108 and 110 to supports 78 and 80 and is rotatable within bearing 112 secured by welding or the like to end plate 24 which is apertured to accommodate shaft 106. Locking collars 114 and 116 secured to shaft 106 maintain the proper position of the mandrel. The outer end of shaft 106 may be formed to the shape of a nut 118 for rotation of the mandrel by the convenient application of a wrench for the purpose described below.

The adjustable construction of the work roll bearings described above is, of course, a preferred embodiment of the invention but is not critical to the successful operation of the apparatus. The work rolls, for example, could be mounted stationary and the mandrel rotated to its operative position in a manner sufficiently precise to apply just the right amount of compression of the belt against the work rolls. Also, either type of adjustable bearing, i.e., 28 or 30, could be used for all of the work rolls.

Figure 4:
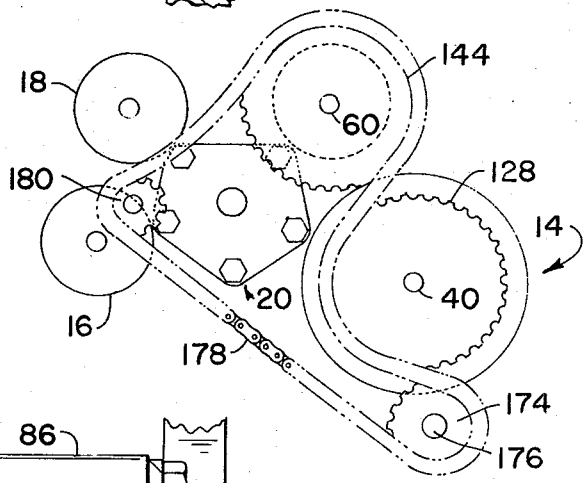
FIG. 4 is a plan view of the drive assembly viewed from the rear of FIG. 1.

Referring to the specific construction of the rollers, the brush roll 14 may be of any effective construction and material which can apply a bristle like cleaning action to the work side of an abrasive belt. Typically the bristle portion of the roll is a plastic, composition board, or other tough material in the form of a sleeve 120 in which preferably stiff nylon bristles 122 are imbedded. This sleeve may be friction fitted or adhesively secured onto a metal cylinder 124 supported by end caps 126 through which the roll shaft 40 passes and is secured. The rearward end of shaft 40 of this brush roll, as shown in FIG. 4, is provided with a chain sprocket 128 which is driven in an opposite direction from drive roll 12 as described below in greater detail.

The drive roll 12 shown in FIG. 3 also may be of any convenient construction such as ends 130 and 132 secured within a rigid sleeve 134 and keyed at 136 and 138 to its shaft 60. A lock collar 140 secured to shaft 60 positions the roll between its bearing housings 54. Suitable antifriction washers such as 142 may be provided to reduce friction resulting from axial displacement of the roll. A chain sprocket 144 is secured to shaft 60 for the purpose further described below.

Figure 2:
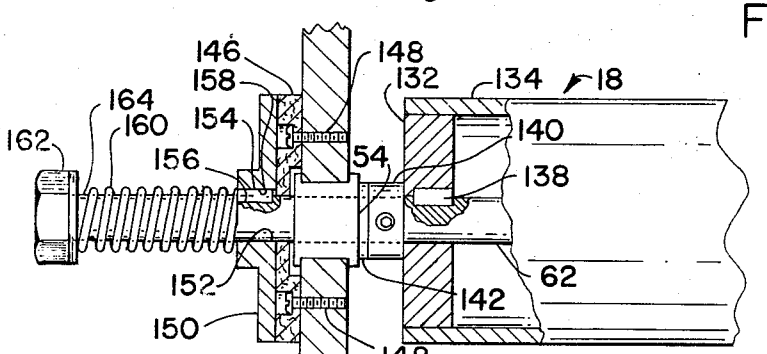
FIG. 2 is a partially sectional view of the friction roller and its mounting.

The drag roll 18 shown in FIG. 2 is conveniently constructed as described above for drive roll 12 and similar parts are numbered the same. The sleeve 134 for this use is preferably of especially abrasive resistant metal such as stainless steel since the abrasive belt may actually tend to slide past its surface. This roll is provided with a friction drag mechanism, one embodiment of which is shown in FIG. 2 as comprising a fibrous-plastic composition friction member 146 which may be of the type employed in automotive clutch discs and the like, secured by screws 148 to end plate 24, and a pressure plate 150 which is apertured at 152 to slide on shaft 62 but which is rotated therewith by means of key 154 fixed in a recess 156 in shaft 62 and a key slot 158 in plate 150 which slidably receives key 154. This construction allows plate 150 to bear with regulatable pressure against member 146. A spring 160 is compressibly adjustable by nut 162 threaded onto the end portion 164 of shaft 62 to provide the required pressure contact between friction member 146 and pressure plate 150 for achieving the proper drag on the abrasive belt. Friction member 146 is dimensioned such that bearing housing 54 can move through its full range or adjustment without being impeded by the member and without causing pressure plate 150 from disengaging the member.

Solvent applicator roll 16 may be constructed similarly to drive roll 12 but need not be driven except by the moving abrasive belt which rotates roll 12 through a solvent bath 166 in tank 168 conveniently secured to the end plates 22 and 24 by brackets 170 and bolts 172. The outer surface of roll 12 may be metal or of a composition or fibrous type material such as felt or the like which will place the proper amount of solvent onto the moving abrasive belt. A circulating and filtering system for the solvent may be located in tank 168 for maintaining good solvent action.

The various rollers which may be employed in practicing the present invention for purposes of driving or feeding the belt, maintaining proper belt tension, applying solvent to the belt, scrubbing the belt, and the like, may be of any practical number and size and may be made of any practical material selected, for example, from steel, ceramic, rubber, polyolefin, elastomer, Nylon, Teflon, or the like.

Referring to FIG. 4, this view is from the back of FIG. 1 and thus the positions of the rolls are reversed. In this view a drive sprocket 174 is shown secured to a drive motor shaft 176. A drive chain 178 links drive sprocket 174, idler sprocket 180, drive roll sprocket 144 and brush roll sprocket 128 such that the latter two are driven in opposite directions as further described below. A gear box or cover 182 for enclosing the sprocket and chain assembly is shown in FIG. 3 mounted on the back of end plate 24.

In the operation of the apparatus a grime and resin clogged continuous abrasive belt 184 such as used in the furniture industry is loaded onto the neutral mandrel, the mandrel then rotated to its operative position, and the drive train then actuated to draw the belt around the mandrel in a clockwise direction. This portion of the belt may be conveniently termed its "working loop." These operations are accomplished as follows. Firstly, the neutral mandrel position is attained by rotating the mandrel in a counterclockwise direction in FIG. 1 sufficient to move the several mandrel rollers 86, 88, 92, and 94 away from their operative positions adjacent the various work stations or work rolls 12, 14, 16 and 18 to neutral positions. It is noted that the allowable inward travel of the bearing housings 54 is such that rolls 12 and 18 will be substantially spaced from the mandrel in its neutral position. This rotation of the mandrel can be accomplished by means of a suitable box wrench 202 or the like applied to the nut shaped end 118 of shaft 106. A rotation of about 15 or 20 degrees or so will suffice. With the mandrel held in this neutral position a continuous belt may be slid through the substantially circular loading port 186 cut out of end plate 22, and over the mandrel to a position occupying all or a portion of the mandrel's length. As seen also in FIG. 1, a supporting table 188 may be provided, particularly for long belts, to assist in loading and unloading, and in feeding the belt to the apparatus during the cleaning operation. When the belt is positioned over the mandrel, the mandrel is rotated back to its operative position shown in FIG. 1 wherein roller 94 presses the belt against drive roll 12, roller 92 maintains the belt in contact with the brush roll bristles, roller 88 urges the belt against solvent applicator roll 16, and roller 86 presses the belt against drag roll 18. The mandrel is then held in this operative position by any suitable means such as holding the aforesaid box wrench 202 in a fixed position by a catch means, such as abutments 204 and 206 which form a slot type catch, or the like affixed to the front face of end plate 22. As the drive train is actuated, the drive roll 12 will pull the belt around the mandrel in a clockwise direction viewed in FIG. 3 against the reverse brushing action of roll 14, the slight retarding effect of solvent roll 16, and the adjustable and more heavy drag of roll 18. This drag on the belt will insure proper belt tension around the mandrel thus effecting more controlled feeding into the mandrel and delivery of the cleaned belt back out onto table 188, and also a more efficient spreading and exposure of the abrasive side of the belt to the various work stations.

In situations where the belts are excessively wide, e.g., 4 or more feet, it may become preferable to provide an anti-sag support for the mandrel such as 190 shown in FIGS. 1 and 5. This support comprises a bar 192 slidably positioned in a slot shaped recess 194 in the front face of end plate 22, and provided with adjusting slots 196, clamp down bolts 198 and an inclined ramp 200 which is the upper surface of the bar. Follower roller 102, shown more clearly in FIG. 5, will ride up on ramp 200 as the mandrel is rotated clockwise to its operative position and thereby assist in maintaining the proper parallel relationship of the mandrel and work roll axes. This ramp is inclined such that counterclockwise rotation of the mandrel to its neutral position will space the ramp from roller 102 sufficiently to allow the belt to be slid readily onto or off of the mandrel. Where it is desired to construct the apparatus for use on very wide belts, intermediate supports such as 190 could be used to contact roller 90 at an intermediate position, and intermediate supports such as 78 could be provided to allow for shorter and more rigid rollers.

It is readily apparent that the apparatus can accommodate practically any size continuous belt without any adjustment or modification of any structural member. The belt 184 shown in FIG. 1 could be any length and would need no support or tensioning roller or the like for its free end loop in order for the belt to be properly cleaned at its working loop. The speed with which the belt should be driven can vary widely, but linear speeds of from about 5 to about 50 feet per minute are practical for many types of belts. Suitable variable speed motors for driving sprocket 174 may be employed to attain the proper belt speed depending on the type and size of the belt and the type and duration of cleaning desired. In this regard, it is noted that the various work stations shown in FIG. 1, while being quite functional, represent only one embodiment of the many possible and practical variations. For example, solvent roll 16 could be replaced by or supplemented with a solvent, air, steam, or combination thereof, spray or jet, and additional mandrel rollers could also be provided to further contour the abrasive surface of the belt to allow greater penetration of the solvent or brush bristles thereinto. Also, a plurality of brushes could be employed and the bristle stiffness varied widely.

In regard to some of the obvious variations for the structural features of the apparatus, hydraulic, air, electrical, solenoid and the like actuators could be employed to perform the functions of components such as springs 64 and screws 44 for adjusting and maintaining the positions of the bearing adjusters, and also for rotating the mandrel between its neutral and operative positions and for maintaining such positions for durations as desired.

Although the invention has been described in considerable detail with particular reference to certain preferred embodiments thereof, variations and modifications can be effected within the spirit and scope of the invention.

I claim:

1. A cleaning apparatus for a continuous belt, comprising a base having elongated belt supporting mandrel means rotatably mounted thereon, said mandrel means having a plurality of belt engaging peripheral portions spaced from the rotational axis thereof, drive roll means for said continuous belt rotatably mounted on said base and having its rotational axis substantially parallel to the rotational axis of said mandrel means, belt cleaning means adjacent the periphery of said mandrel means and adapted to engage said belt, and a first one of said peripheral portions of said mandrel means being movable substantially parallelly into close juxtaposition to the periphery of said drive roll means upon rotative movement of said mandrel means.

2. The apparatus of claim 1 wherein the axis of said mandrel means is eccentrically positioned with respect to portions of its periphery such that rotation of said mandrel means about its axis will change the radial dimension of said mandrel means in a given stationary plane through said axis.

3. The apparatus of claim 1 wherein said mandrel means comprises a plurality of individual, substantially parallel rollers rotatably mounted on a support which is rotatably mounted on said base.

4. The apparatus of claim 3 wherein said belt cleaning means comprises driven, rotatable brush means provided to contact said belt as it is pulled around said mandrel means, said brush means being driven in a direction opposite to the direction of travel of said belt through said apparatus.

5. The apparatus of claim 3 wherein said support is rotatably mounted on said base by means of a shaft and bearing assembly, and is provided with a locking mechanism for releaseably holding said mandrel in an angular position whereby a roller thereof is maintained in contact with said belt which is maintained in contact with said drive roll means.

6. The apparatus of claim 3 wherein means is provided to continually urge said drive roll means toward said mandrel means.

7. The apparatus of claim 1 provided with friction roll means mounted on said base and having its rotational axis substantially parallel to the axis of said mandrel means, and a second one of said peripheral portions of said mandrel means being movable substantially parallelly into close juxtaposition to the periphery of said friction roll means upon rotation of said mandrel means.

8. The apparatus of claim 7 wherein said first and second peripheral portions are individual rollers which move simultaneously with rotation of said mandrel means.

9. The apparatus of claim 8 wherein at least one additional of said peripheral portions moves with said first and second portions to move a belt into a working position at a cleaning station.

10. The apparatus of claim 1 wherein said mandrel means is rotatably supported at one end on said base.

* * * * *